United States Patent [19]

Hattori

[11] 4,019,232

[45] Apr. 26, 1977

[54] RAM TYPE STEEL BAR COUPLING APPARATUS

[75] Inventor: Seiji Hattori, Nagoya, Japan

[73] Assignee: Daido Seiko Kabushiki Kaisha, NagoyaJA

[22] Filed: Dec. 3, 1975

[21] Appl. No.: 637,178

[30] Foreign Application Priority Data

| | | |
|---|---|---|
| Dec. 4, 1974 | Japan | 49-139288 |
| May 12, 1975 | Japan | 50-55657 |
| May 12, 1975 | Japan | 50-55658 |

[52] U.S. Cl. ..... 29/282; 29/283.5; 29/517

[51] Int. Cl.[2] ..... B21D 39/04; B23P 19/04

[58] Field of Search ..... 29/237, 517, 520, 282, 29/234, 200 R, 200 B, 282; 72/467, 418, 453, 357, 284

[56] References Cited

UNITED STATES PATENTS

| | | | |
|---|---|---|---|
| 3,579,794 | 5/1971 | Powell | 29/520 X |
| 3,732,715 | 5/1973 | Zamorano | 29/517 |
| 3,921,281 | 11/1975 | Hattori et al. | 29/520 |

*Primary Examiner*—Milton S. Mehr

*Attorney, Agent, or Firm*—Stevens, Davis, Miller & Mosher

[57] ABSTRACT

An apparatus for coupling two bars by one sleeve, which comprises dies, a die frame for supporting said dies, rods connected to one end of said frame, a bottom frame attached to the other ends of said rods, an intermediate frame supported on said rods between said die frame and said bottom frame so that it can slide along said rods and a hydraulic unit including many cylinders that can be interposed between said bottom frame and said intermediate frame to slide said intermediate frame along said rods.

1 Claim, 35 Drawing Figures

M
L
K
a
b
c
d
e
f
g
h
A
B
210a
210b
211
212
213
214
215
216
217
218
219
220
221
222
223
225a
225b
226a
226b
227
228a
228b
229a
229b
230
233
236
237
238
239
240
241
246

RAM TYPE STEEL BAR COUPLING APPARATUS

This invention relates to a ram type steel bar coupling apparatus.

Conventional ram type steel bar coupling apparatus for coupling two deformed bars by one sleeve comprise, in general, die means having an inner diameter of the bearing portion smaller than the outer diameter of the sleeve, a die frame for supporting said die means, a bottom frame supporting one end of the sleeve, and a hydraulic device for sliding the bottom frame along rods connected to the die frame.

When a conventional coupling apparatus of this type is used for coupling steel bars of a building in the construction field, its handling or conveyance is very inconvenient because it has a large size and a heavy weight. Further, the rods are often a hindrance when the die means is set to the die frame. Especially when pitches among a great number of steel bars disposed in the building are relatively narrow, it is convenient to use a coupling apparatus having such a large size and it is difficult to set the die means to the die frame in the conventional coupling apparatus.

It is therefore a primary object of this invention to provide a steel bar coupling apparatus comprising two separable units of relatively small size and a relatively light weight, which can easily be handled and conveyed and can be effectively and conveniently used even when steel bars disposed at relatively narrow pitches are coupled.

Another object of the present invention is to provide a steel bar coupling apparatus in which the die frame can be set to die means very easily.

Still another object of the present invention is to provide a steel bar coupling apparatus, the entire length of which is considerably shortened.

In accordance with the first aspect of the present invention, there is provided an apparatus for coupling two deformed steel bars by one sleeve, which comprises split dies having a bearing portion smaller than the outer diameter of said sleeve, a substantially U-shaped die-frame for supporting said dies, rods connected to one end of said die frame, a substantially U-shaped bottom-frame attached to the other ends of said rods, a substantially U-shaped intermediate-frame supported on said rods between said die frame and said bottom frame so that it can freely slide along said rods and a substantially U-shaped hydraulic pressure unit including a plurality of cylinders that can be interposed between said bottom frame and said intermediate frame to slide said intermediate frame along said rods.

In accordance with the second aspect of the present invention, there is provided a steel bar coupling apparatus as set forth above, wherein said dies comprise upper and lower dies split and separated from each other in a plane passing through the axial line of said dies, the split faces of said upper and lower split dies have convex and concave parts to be engaged with each other, said die frame has supporting faces for supporting said upper and lower dies, respectively, the supporting face for said upper die being a face parallel to said axial line and the supporting face for said lower die being an inclined face confronting said intermediate frame, and wherein said upper die has a shoulder face corresponding to said parallel face and said lower die has an inclined face corresponding to said inclined face.

In accordance with the third aspect of the present invention, there is provided a steel bar coupling apparatus as set forth above, wherein said intermediate-frame includes a supporter that can be freely opened or closed, said supporter being arranged so that when it is closed, it can support one end of said sleeve and when it is opened, said sleeve can be inserted thereinto, and wherein said hydraulic pressure unit has a supporting face for supporting one end of said sleeve when said sleeve is inserted into said supporter.

Other objects and advantages of the present invention will be apparent from the following embodiments illustrated by reference to the accompanying drawings, in which.

Figure 1:
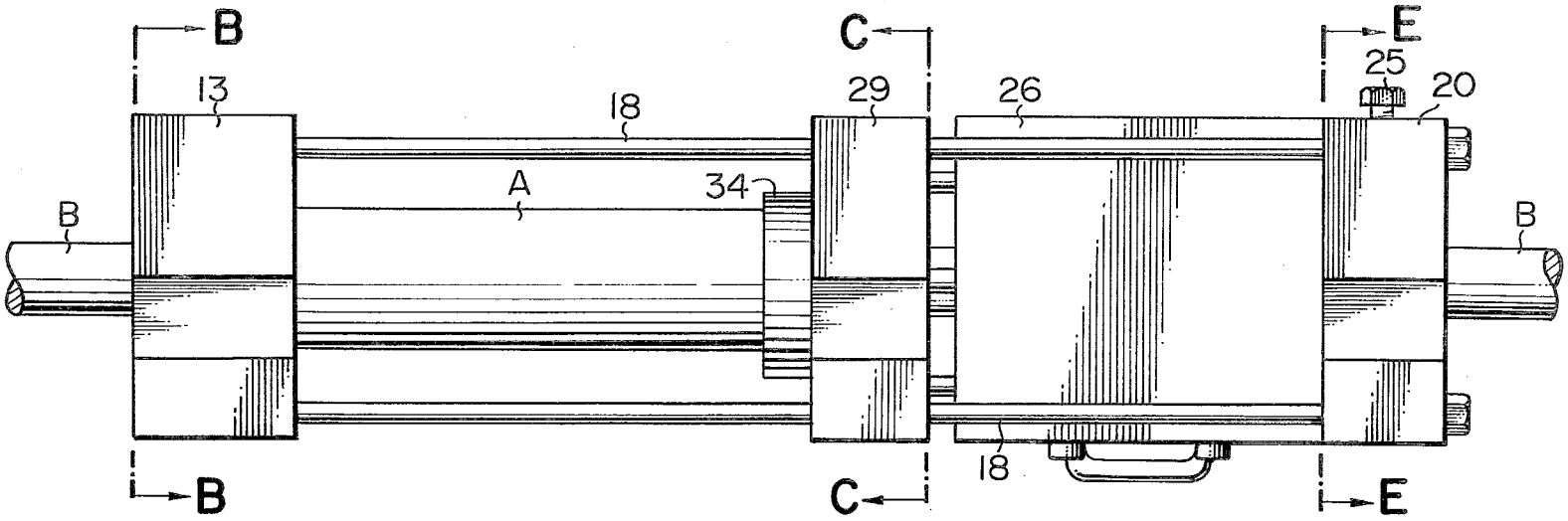
FIG. 1 is a view showing the longitudinal section of the first embodiment of the steel bar coupling apparatus of the present invention at the time of assembling.
Figure 2:
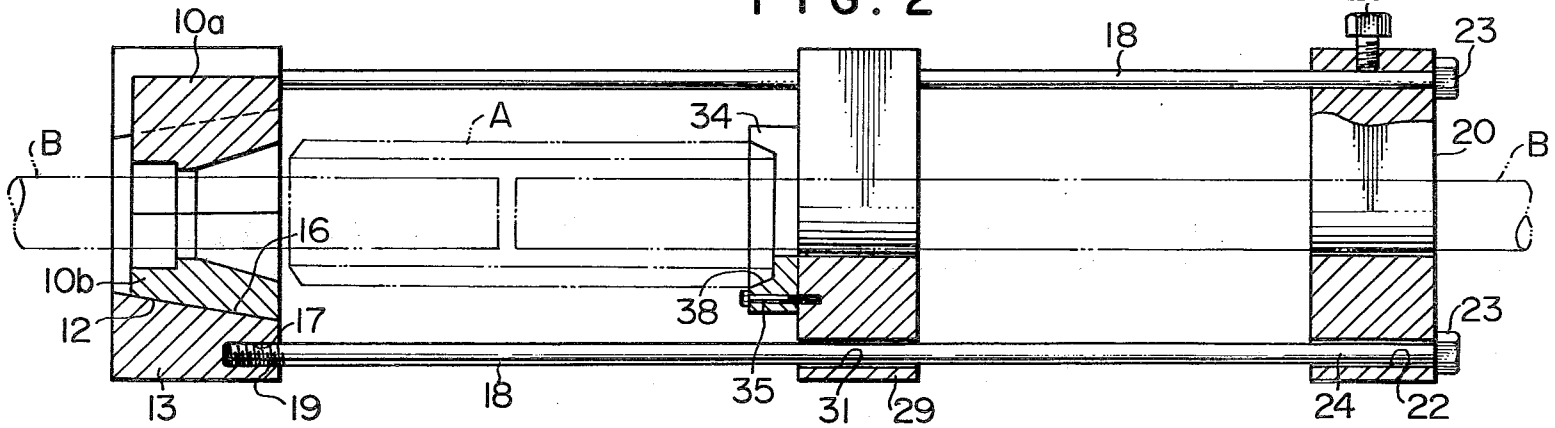
FIG. 2 is a view showing the longitudinal section of the processing unit.
Figure 3:
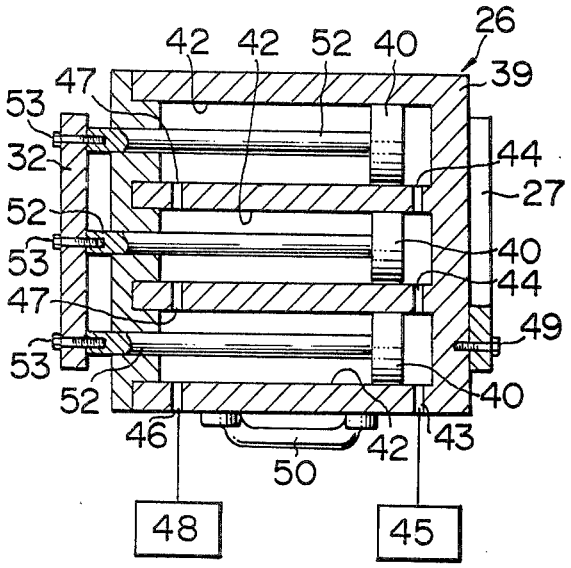
FIG. 3 is a view showing the longitudinal section of the hydraulic pressure unit taken along the line A—A in FIG. 5.
Figure 4:
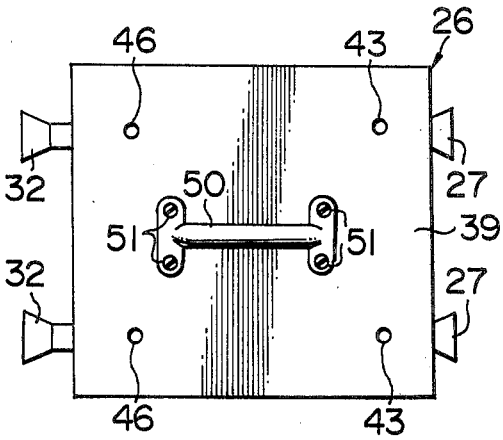
FIG. 4 is a side view of the hydraulic pressure unit.
Figure 5:
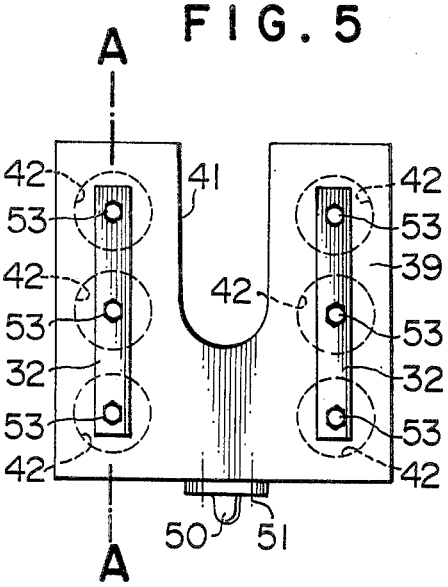
FIG. 5 is a front view of the hydraulic pressure unit.
Figure 6:
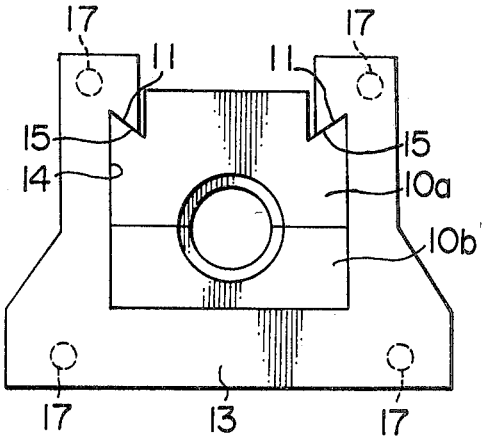
FIG. 6 is a front view of the die frame seen along the line B—B in FIG. 1.
Figure 7:
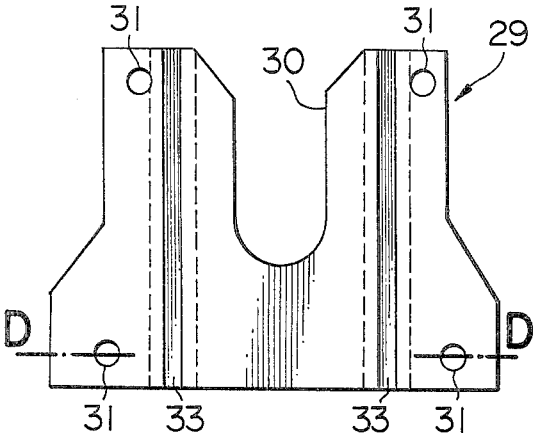
FIG. 7 is a front view of the intermediate frame seen along the line C—C in FIG. 1.
Figure 10:
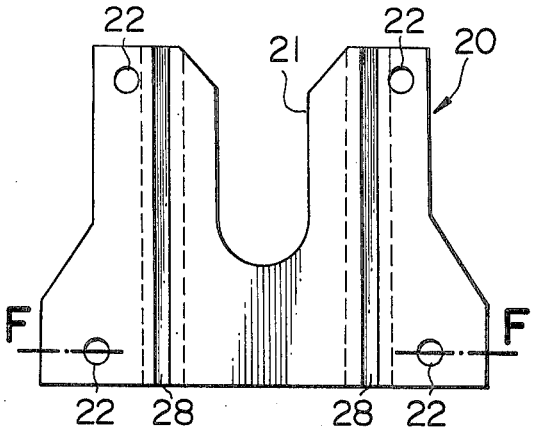
FIG. 10 is a front view of the bottom frame seen along the line E—E in FIG. 1.
Figure 8:
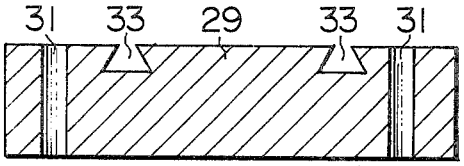
FIG. 8 is a view showing the section taken along the line D—D in FIG. 7.
Figure 11:
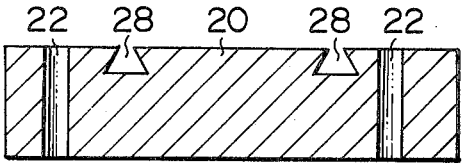
FIG. 11 is a view showing the section taken along the lines F—F in FIG. 10.

Referring now to FIGS. 1 to 11, the split dies comprises an upper die 10*a* and a lower die 10*b*, and they have a bearing portion smaller than the outer diameter of a sleeve A. The upper die 10*a* has inclined shoulder faces 11 and the lower die 10*b* has an inclined bottom face 12.

A die frame 13 for supporting and holding the dies 10*a* and 10*b* is substantially U-shaped and it has an opening 14 embracing the dies 10*a* and 10*b* therein. This opening 14 has inclined faces 15 corresponding to the shoulder faces 11 of the upper die 10*a* and an inclined face 16 corresponding to the inclined bottom face 12 of the lower die 10*b*. The shoulder faces 11 of the die 10*a* are supported by the inclined faces 15 and the bottom face 12 of the die 10*b* is supported by the inclined face 16.

The die frame 13 has screw holes 17 perforated at the four corners of one side thereof, and coupling rods 18 are screwed and attached to these screw holes 17 at one screwed end portions thereof, respectively.

A bottom frame 20 is substantially U-shaped and has an opening 21 for embracing a steel bar B therein. Insertion holes 22 are perforated at the four corners of the bottom frame 20.

The other end portion 24 of each rod 18 has a head 23 and this end portion 24 is inserted into the insertion hole 22 and fixed to the bottom frame 20 by a setting bolt 25.

The bottom frame 20 has on the inner side face parallel key ways 28 into which parallel keys 27 of the hydraulic unit 26 detailed below are to be inserted.

The intermediate frame 29 is substantially U-shaped and has an opening 30 for embracing a steel bar B therein. Insertion holes 31 are perforated at the four corners of the intermediate frame 29.

Each rod 18 is inserted into the insertion hole 31, and hence, the intermediate frame 29 can slide along the rods 18.

One side of the intermediate frame 29 that confronts the bottom frame 20 has parallel key ways 33 into which other parallel keys 32 of the hydraulic pressure unit 26 are to be inserted.

A holding member 34 is attached by a bolt 35 to one side face of the intermediate frame 29 that confronts the die frame 13.

The holding member 34 has a notched disc form and an opening 36 for embracing a steel bar B therein is formed on the holding member 34. Further, the sheet 34 has bolt holes 37 on the circumferential portion and a socket 38 for receiving one end of the sleeve A in the central portion.

The hydraulic unit 26 comprises a cylinder block 39 and a piston 40.

The cross-section of the cylinder block 39 is substantially U-shaped and the cylinder block 39 has an opening 41 for embracing a steel bar B therein. The cylinder block 39 includes therein two rows of cylinders 42, each row having three cylinders 42, and on the side wall of the cylinder block 39, there are disposed inlet port 43 and connecting port 44 which are connected to one ends of respective cylinders 42 in succession. The inlet port 43 is connected to a hydraulic source 45. There are also disposed exit port 46 and connecting port 47 which are connected to the other ends of the cylinders 42 in succession. The exit port 46 is connected to a hydraulic source 48.

The above-mentioned parallel keys 27 are attached to the outer face of one end wall of the cylinder block 39 by means of bolts 49, and a handle 50 is attached to the side of the cylinder block 39 by means of bolts 51.

Two rows of pistons 40 are aligned and each row includes three pistons. A rod 52 of each piston 40 is penetrated through the other end wall of the cylinder block 39, and the key 32 is attached to the outer end of each rod 52 by means of a bolt 53.

One end portions of two deformed steel bars B are inserted into the sleeve A, and one steel bar B is embraced by the split dies 10*a* and 10*b* and the assembly is supported on the opening 14 of the die frame 13. The other steel bar B is placed in the openings 30 and 21 of the intermediate frame 29 and bottom frame 20, and ends of the sleeve A are placed in bell portions of the split dies portions 10*a* and 10*b* and the socket 38 of the holding member 34, respectively.

Then, the hydraulic unit 26 is set between the intermediate frame 29 and bottom frame 20 by inserting the keys 27 and 32 into the key ways 28 and 33.

Figure 12:
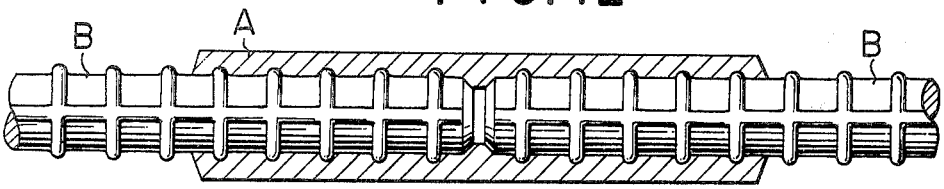
FIG. 12 is a view showing the longitudinal section of steel bars coupled by the sleeve.
Figure 13:
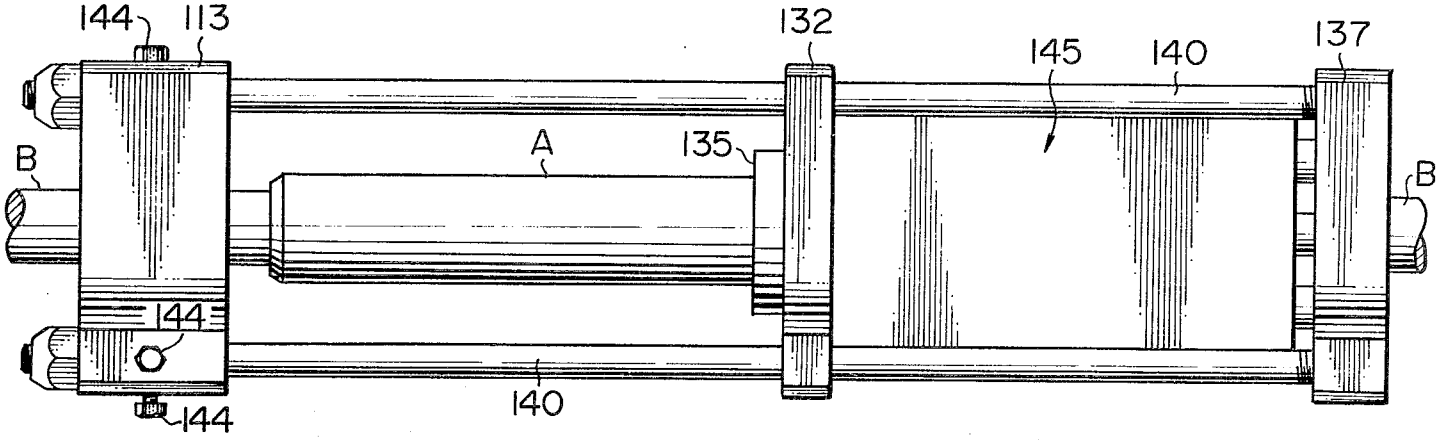
FIG. 13 is a side view showing the second embodiment of the coupling apparatus of the present invention at the time of assembling.
Figure 14:
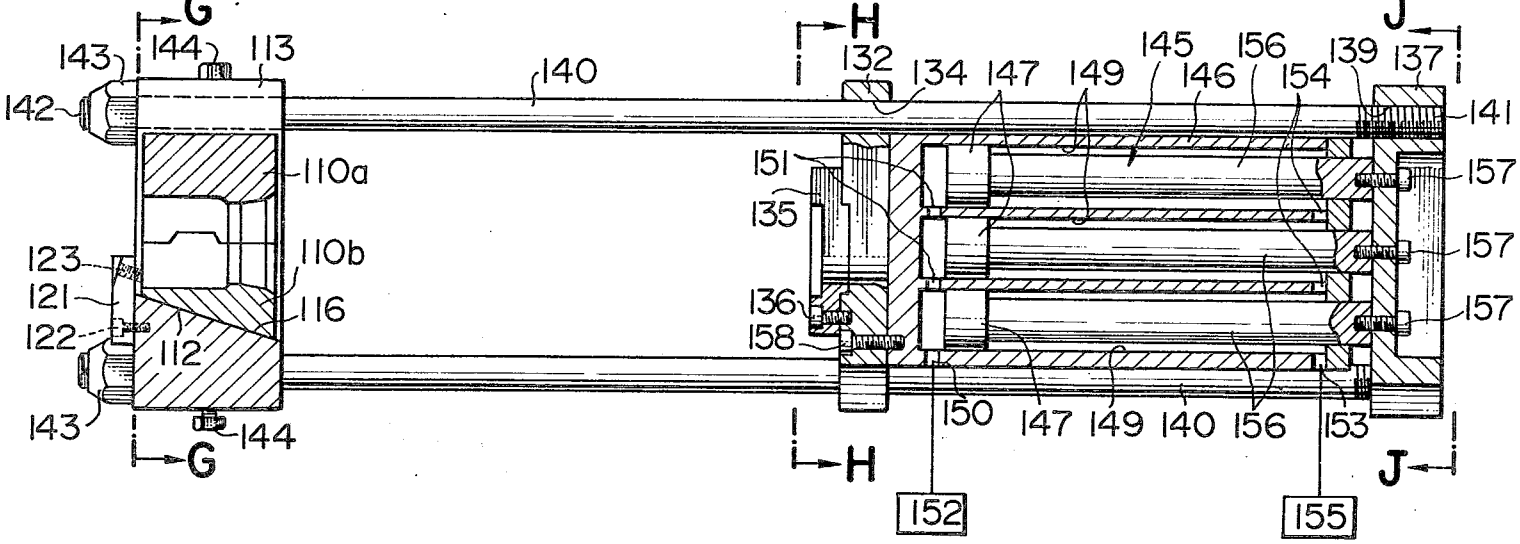
FIG. 14 is a view showing the section taken along the line a—b—c—d in FIG. 17.
Figure 15:
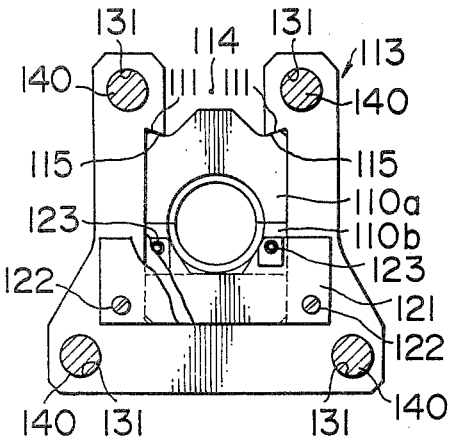
FIG. 15 is a front view seen along the line G—G in FIG. 14.
Figure 16:
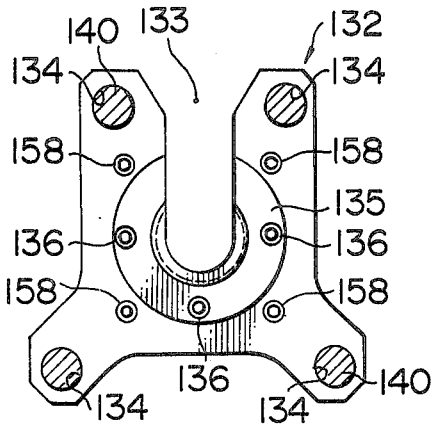
FIG. 16 is a front view seen along the line H—H in FIG. 14.
Figure 17:
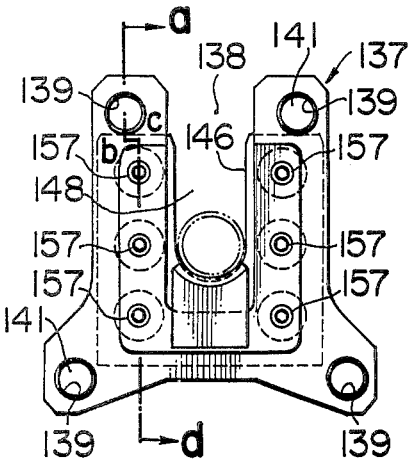
FIG. 17 is a front view seen along the line J—J in FIG. 14.
Figure 18:
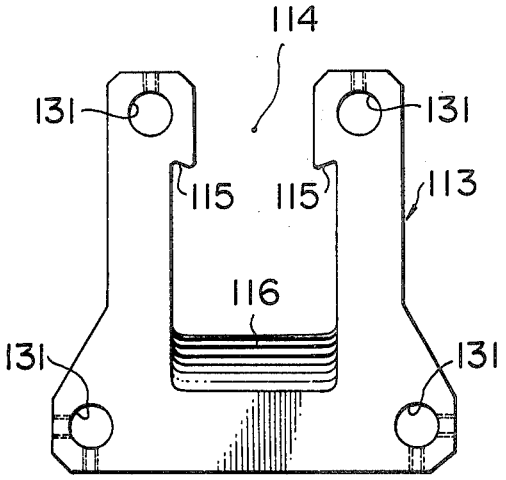
FIG. 18 is a front view of the die frame.
Figure 19:
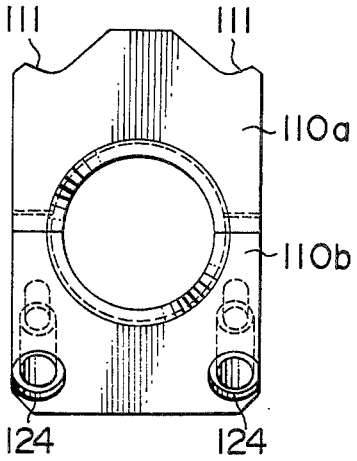
FIG. 19 is a front view of the split dies.
Figure 20:
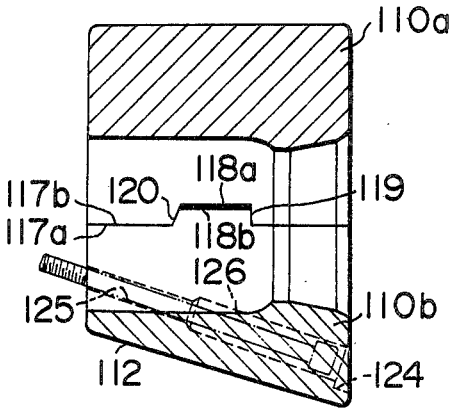
FIG. 20 is a view showing the longitudinal section of the split dies.
Figure 21:
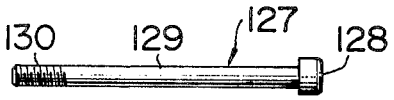
FIG. 21 is a side view of the bolt.

By operation of the hydraulic unit 26, the intermediate frame 29 is shifted and the sleeve A is swaged by the split dies portions 10*a* and 10*b*, whereby the metal of the sleeve A is subjected to plastic deformation and clamped tightly to the deformed steel bars B. Thus, the two steel bars B are coupled by the sleeve A as shown in FIG. 12.

The hydraulic pressure unit 26 is then operated reversely, and it is taken out of the intermediate frame 29 and bottom frame 20 and the split dies are separated from the sleeve.

In the coupling apparatus of the present invention, the hydraulic pressure can be separated from the processing unit comprising the die frame, intermediate frame, bottom frame and connecting rods. Accordingly, these units can be conveyed separately with ease. Further, since the hydraulic pressure unit includes a plurality of cylinders and the load is distributed to respective cylinders, the entire structure of the hydraulic pressure unit can be made compact. Therefore, even when pitches of steel bars are relatively narrow, the apparatus of the present invention can be operated very conveniently, and conveyance of the apparatus of the present invention can be performed very easily.

Moreover, according to the present invention, there may be adopted an effective method in which a plurality of processing units such as mentioned above are pre-set for a plurality of sets of steel bars to be coupled and one hydraulic pressure unit is connected to these processing units one by one to effect the coupling operation in respective processing units in succession. If this method is adopted, manufacturing efficiency can be greatly enhanced.

The second embodiment according to the second aspect of the present invention will now be illustrated by reference to FIGS. 13 to 22.

The split dies comprises an upper die 110*a* and a lower die 110*b* which are separated from each other in a plane passing through the axial line. The upper die 110*a* has shoulder faces 111 parallel to the axial line and the lower die 110*b* has an inclined bottom face 112.

A die frame 113 for supporting and holding dies 110*a* and 110*b* is substantially U-shaped and has an opening 114 for embracing therein the die portions 110*a* and 110*b*. This opening 114 has parallel faces 115 for supporting the shoulder faces 111 of the upper die 110*a* and an inclined face 116 for supporting the inclined bottom face 112 of the lower die 110*b*.

Split faces 117*a* and 117*b* of the split die portions 110*a* and 110*b* have concave and convex parts 118*a* and 118*b* to be engaged with each other, and these concave and convex parts 118*a* and 118*b* have a face 119 perpendicular to the axial line on the bell side of the die and an inclined face 120 on the relief side of the die.

A plate 121 is attached to the outer side face of the die frame 113 by a setting bolt 122, and screw holes 123 are perforated on the plate 121 with an inclination angle parallel to the inclined faces 112 and 116.

The lower die 110*b* has insertion holes 124 parallel to the inclined faces 112 and 116, and each insertion hole 124 comprises an upper small-diameter portion 125 and a lower large-diameter portion 126.

A bolt 127 is inserted into the insertion hole 124, and the head 128 of the bolt 127 is contained in the large-diameter portion 126 and the shank 129 of the bolt 127 is contained in the small-diameter portion 125. A screwed portion 130 on one end of the shank 129 is screwed into the screw hole 123 of the plate 121.

The die frame 113 has insertion holes 131 perforated at the four corners thereof.

Figure 9:
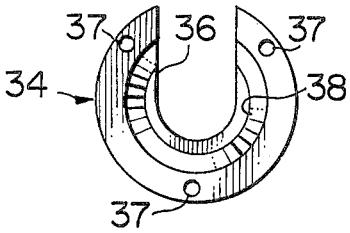
FIG. 9 is a front view of the holding member.

The intermediate frame 132 is substantially U-shaped and has an opening 133 for embracing therein a steel bar B and insertion holes 134 perforated at the four corners thereof. A holding member 135 similar to the holding member 34 shown in FIG. 9 is attached to one side face of the intermediate frame 132 by means of bolts 136.

The bottom frame 137 is substantially U-shaped, and it has an opening 138 for embracing therein a steel bar B and screw holes 139 perforated at the four corners thereof.

A connecting rod 140 is inserted into the insertion hole 131 of the die frame 113 and the insertion hole 134 of the intermediate frame 132, and a screwed portion 141 on one end of the rod 140 is screwed into the screw hole 139 of the bottom frame 137 and a nut 143 is screwed into a screwed portion 142 on the other end of the rod 140 on the outer face of the die frame 113. Further, a setting bolt 144 is fitted. Thus, the connecting rod 140 is fixed to the die frame 113.

A hydraulic unit 145 comprises a cylinder block 146 and a piston 147.

The cylinder block 146 has a substantially U-shaped section and an opening 148 for embracing therein a steel bar B. In the interior of the cylinder block 146 there are aligned two rows of cylinders 149, each row including three cylinders 149. On the side wall of the cylinder block 146 there are disposed inlet port 150 and connecting port 151 which are connected to one ends of respective cylinders 149 in succession. The inlet port 150 is connected to a hydraulic pressure source 152. Further, the cylinder block 146 has exit port 153 and connecting port 154 which are connected with the other ends of the respective cylinders 149 in succession. The exit port 153 is connected to a hydraulic pressure source 155.

Two rows of pistons 147 are aligned and each row includes three pistons 147. A rod 156 of each piston 147 is penetrated through one end wall of the cylinder block 146 and the outer end of each rod 156 is attached to the bottom frame 137 by means of a bolt 157. The other end wall of the cylinder block 146 is attached to the intermediate frame 132 by means of a bolt 158.

The operation of the second embodiment of the coupling apparatus of the present invention will now be described.

The upper die 110*a* is taken out of the die frame 113, and one end portions of two deformed steel bars are inserted into the sleeve A and embraced by the opening 114 of the die frame 113, the opening 113 of the intermediate frame 132, the opening 148 of the hydraulic pressure unit 145 and the opening 138 of the bottom frame 137. One end of the sleeve A is supported by the socket of the holding member 136.

Figure 22:
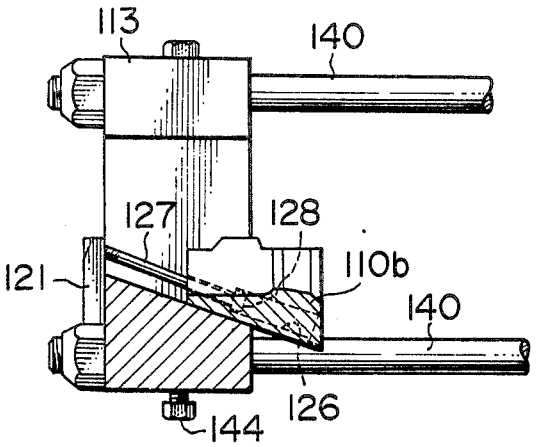
FIG. 22 is a view showing the longitudinal section of a part of the second embodiment shown in FIG. 13, which illustrates the hung-down state of the lower die.

Then, the lower die 110*b* is shifted outside the die frame 113 along the bolt 127. In this case, the head 128 of the bolt 127 is relatively moved along the large-diameter portion 126 of the insertion hole 124 of the lower die 110*b* and the head 128 is caught by the small-diameter portion of the insertion hole 124. Accordingly, the lower die 110*b* is hung down without being taken out of the die frame 113 as shown in FIG. 22.

Then, the upper die 110*a* is inserted into the opening 114 of the die frame 113 from the outside thereof.

Subsequently, the lower die 110*b* is returned into the interior of the die frame 113 and concave and convex parts 118*a* and 118*b* of the upper and lower dies 110*a* and 110*b* are engaged with each other.

Then, the hydraulic pressure unit 145 is actuated in the same manner as described above in the first embodiment to effect the coupling operation.

After completion of the coupling operation, the sleeve A and split dies 110*a* and 110*b* are jointly projected from within the die frame 113, and the upper die 110*a* alone is dismounted from the die frame 113.

According to the above-illustrated second embodiment of the present invention, since the upper die can be set from the outside of the die frame, the connecting rod 140 brings about no hindrance for mounting or dismounting of the upper die and hence, the upper die can be mounted or dismounted very easily and conveniently. Even if pitches among steel bars are relatively narrow, mounting or dismounting of the upper die can be accomplished with ease. Further, since the lower die is always hung down from the die frame, setting of the split die can be accomplished very efficiently.

The third embodiment according to the third aspect of the present invention will now be described by reference to FIGS. 23 to 35.

The split dies comprises an upper die 210*a* and a lower die 210*b* which are separated from each other by a plane passing through the axial line. The upper die 210*a* has shoulder faces 211 parallel to the axial line and the lower die 210*b* has an inclined bottom face 212.

A die frame 213 is substantially U-shaped and has an opening 214 for embracing therein the split die. The opening 214 includes parallel faces 215 for supporting the shoulder faces 211 of the upper die 210*a* and an inclined face 216 for supporting the inclined bottom face of the lower die 210*b*.

The die frame 213 has insertion holes 217 perforated at the four corners thereof.

A plate 218 is attached to the outer side face of the die frame 213 by means of a setting bolt 219.

An intermediate frame 220 is substantially U-shaped and has an opening 221 for embracing a steel bar B therein. The intermediate frame 220 has insertion holes 222 perforated at the four corners thereof.

A supporter 223 is attached to one side face of the intermediate frame 220 that confronts the die frame 213.

The supporter 223 comprises a pair of symmetric support members 225*a* and 225*b* having semicircular grooves 224*a* and 224*b* at the centers thereof each having a diameter a little larger than the outer diameter of the steel bar B. These support members 225*a* and 225*b* overlap each other at one ends thereof and each support member is formed into two branches. One legs 226*a* and 226*b* of the sheets 225*a* and 225*b* are attached to the intermediate frame 220 by means of bolts 227, so that each sheet can turn around the bolt 227. The other legs 228*a* and 228*b* have hook-like grooves 229*a* and 229*b* on the insides thereof, respectively. Each support member is connected to the intermediate frame 220 also by a spring 230. The other ends of the support members 225*a* and 225*b* are always stretched by the spring 230 to form an opening, and the legs 228*a* and 228*b* are made close to each other. When a cotter 231 is pressed between the inside grooves 229*a* and 229*b* of the legs 228*a* and 228*b*, said other ends of the respective sheets are closed, whereby the semicircular grooves 224*a* and 224*b* are caused to confront each other and an annular supporting face 232 for supporting one end of the sleeve A is formed on the faces of the two sheets.

A bottom frame 223 is substantially U-shaped and has an opening 234 for embracing therein a steel bar B. The bottom frame 234 has screw holes 235 perforated at the four corners thereof.

A connecting rod 236 is inserted into the insertion hole 217 of the die frame 213 and the insertion hole 222 of the intermediate frame 220. A screwed portion 237 on one end of the rod 236 is screwed into the screw hole 235 of the bottom frame 233, and a nut 239 is screwed into a screwed portion 238 on the other end of the rod 236 on the outer side face of the die frame 213. The rod 236 is fixed to the die frame 213 also by means of a setting bolt 240.

A hydraulic pressure unit 241 comprises a cylinder block 242 and a piston 243.

The cylinder block 242 has s substantially U-shaped cross-section, and it has an opening 244 for embracing therein a sleeve A and an opening 245 for embracing a steel bar B therein.

The opening 244 for the sleeve A is formed on the side confronting the intermediate frame 220 and its length *a* in the axial direction is substantially equal to the half of the length of the cylinder block 242 in the axial direction. The opening 245 for the steel bar B is formed on the side confronting the bottom frame 233 and its length *b* in the axial direction is substantially equal to the half of the cylinder block 242 in the axial direction. The cylinder block 242 has a supporting face 246 of a notched circular form for supporting one end of the sleeve A on the boundary between the opening 244 and the opening 245. By this arrangement, steel bars B can be embraced by the opening 244.

The cylinder block 242 has in the interior thereof 2 rows of cylinders 248, each row including three cylinders 248. On the side wall of the cylinder block 242, there are disposed inlet port 249 and connecting port 250 which are connected to one ends of respective cylinders 248 in succession. The inlet port 249 is connected to a hydraulic pressure source 251. The cylinder block 242 further comprises exit port 252 and connecting port 253 which are connected to the other ends of respective cylinders 248. The exit port 252 is connected to a hydraulic pressure source 254.

Two rows of piston 243 are aligned, each row including three pistons 243, and rod 255 of each piston 243 is penetrated through one end wall of the cylinder block 242. The outer end of each rod 255 is attached to the bottom frame 233 by means of a bolt 256. The other end wall of the cylinder block 242 is attached to the intermediate frame 22 by means of bolts 257.

The operation of the coupling apparatus of the third embodiment of the present invention will now be described.

The upper die 210*a* is separated from the die frame 213, and two steel bars B are inserted into the sleeve A and are embraced within the die frame 213, the intermediate frame 220 and the bottom frame 233. Then, the sleeve A is inserted into the opened support members 225*a* and 225*b* of the supporter 223 and the opening 244 of the cylinder block 242, and one end of the sleeve A is struck onto the supporting face 246.

Figures 23, 26, 27:
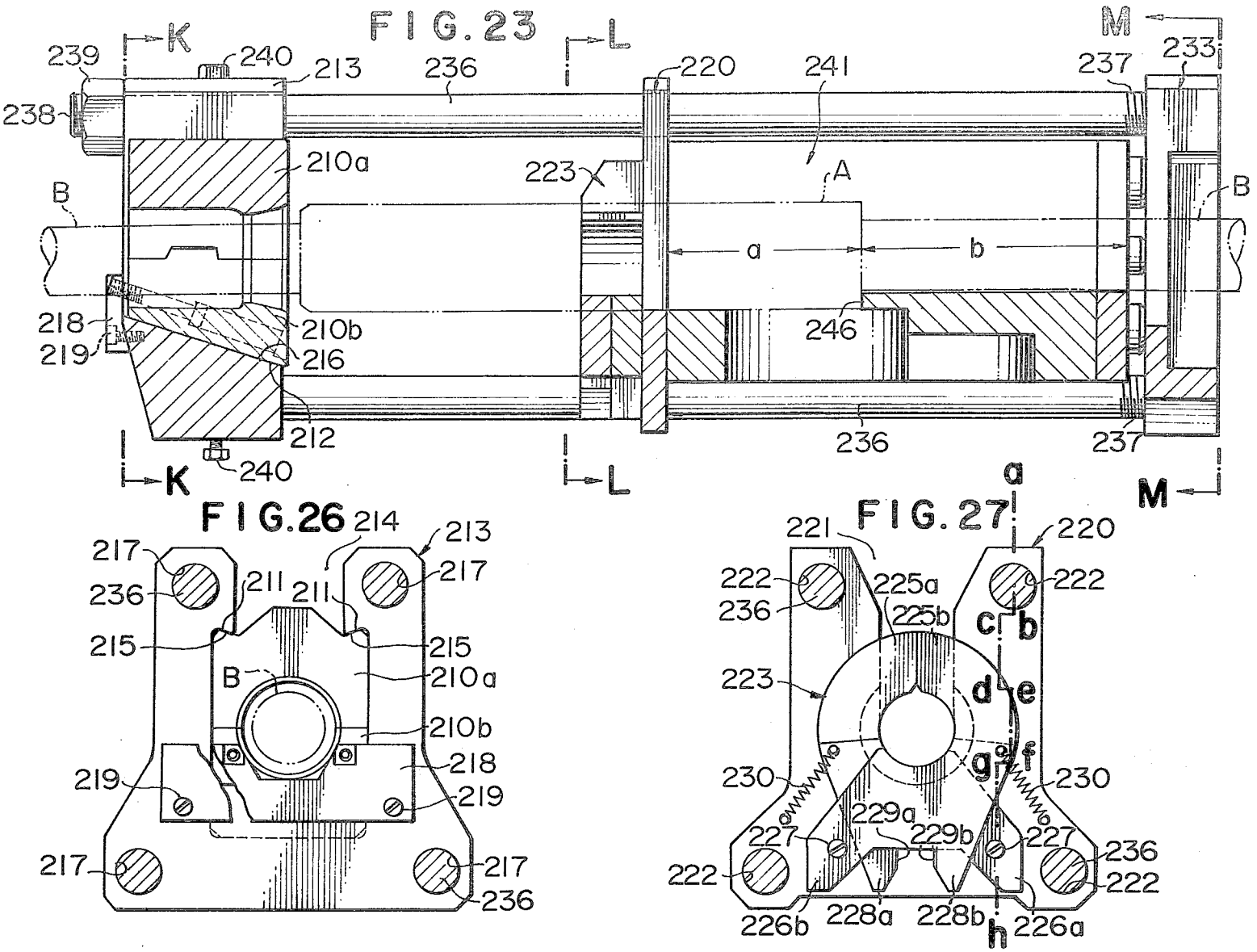
FIG. 23 is a view showing the longitudinal section of the third embodiment of the coupling apparatus of the present invention.
FIG. 26 is a front view seen along the line K—K in FIG. 23.
FIG. 27 is a front view seen along the line L—L in FIG. 23.

Then, the lower die 210*b* and upper die 210*a* are set as shown in FIG. 23.

Figure 24:
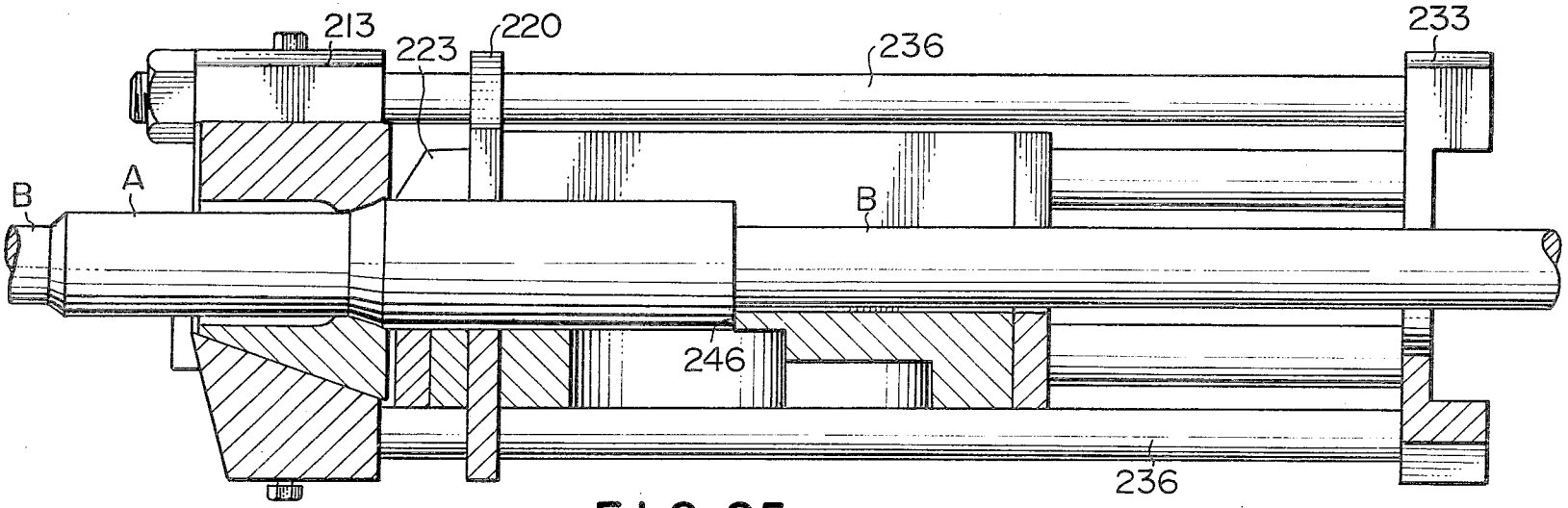
FIG. 24 is a view, similar to FIG. 23, showing the state where a half of the sleeve is swaged.

When the hydraulic pressure unit 241 is actuated, the sleeve A is swaged along a distance substantially equal to the half of the length of the sleeve A as shown in FIG. 24.

Then, the hydraulic pressure unit is operated reversely and it is returned to the original posisition, whereby said one end of the sleeve A is located outside the supporter 233. In this case, the swaged portion of the sleeve A is hold by the split die.

Figure 25:
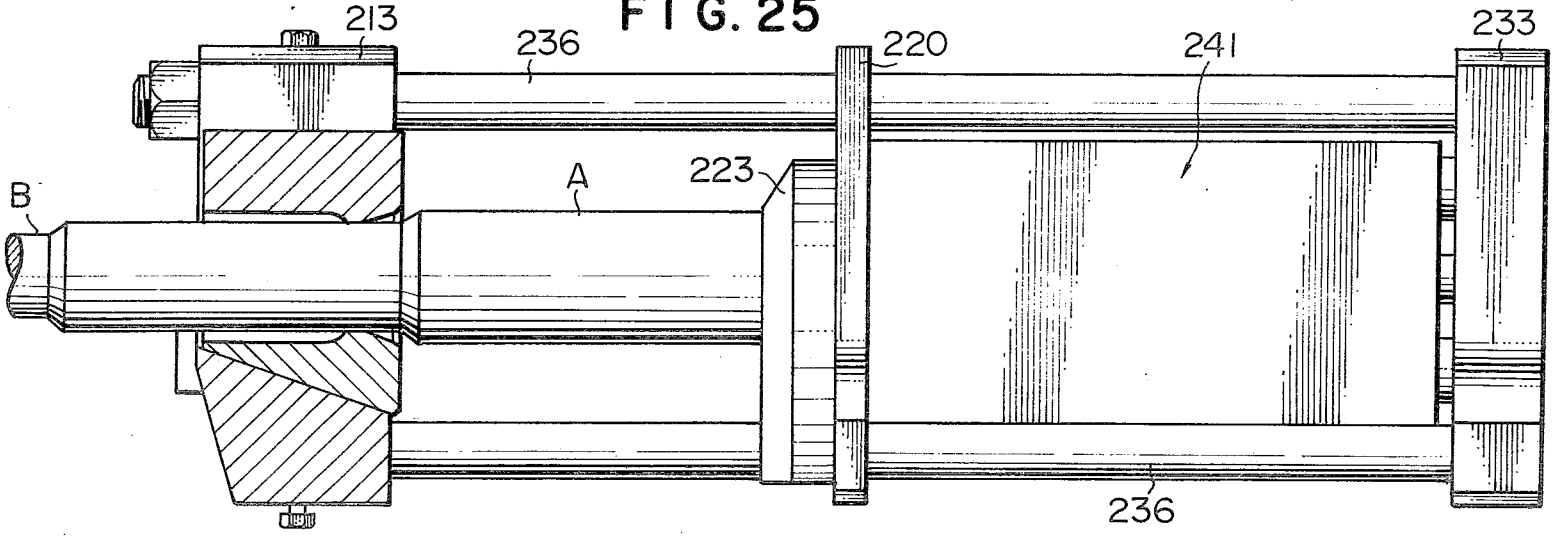
FIG. 25 is a view, similar to FIG. 23, showing the state before swaging of the remaining half of the sleeve.
Figure 29:
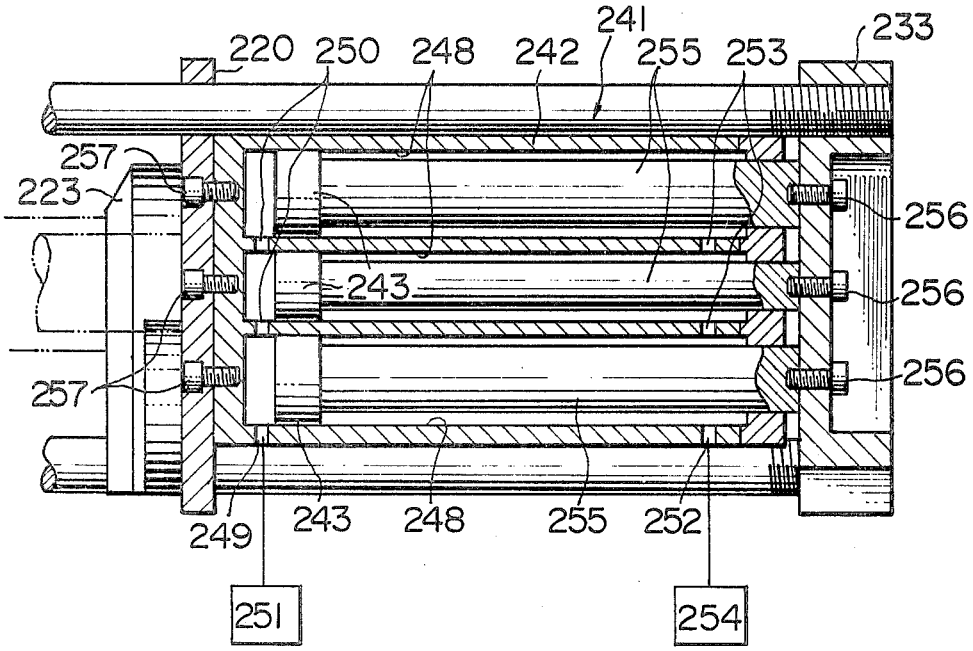
FIG. 29 is a view showing the longitudinal section taken along the line a—b—c—d—e—f—g—h in FIG. 27.
Figure 28:
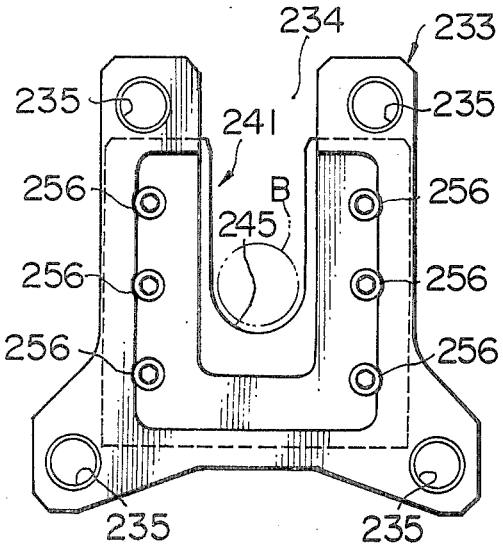
FIG. 28 is a front view seen along the line M—M in FIG. 23.
Figure 30:
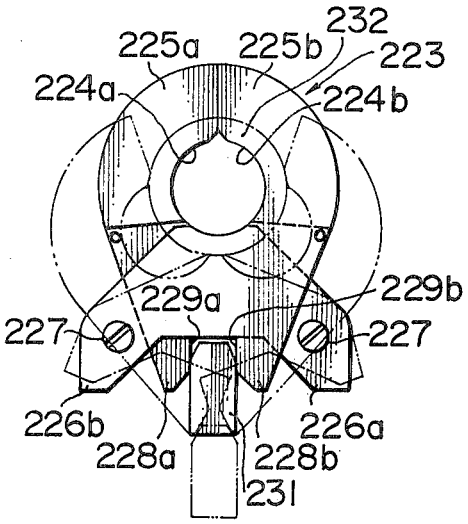
FIG. 30 is a front view of the supporter.
Figure 31:
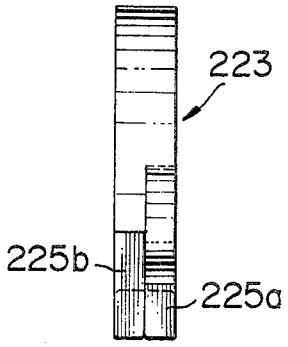
FIG. 31 is a side view of the supporter.
Figure 32:
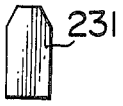
FIG. 32 is a side view of the cotter.
Figure 33:
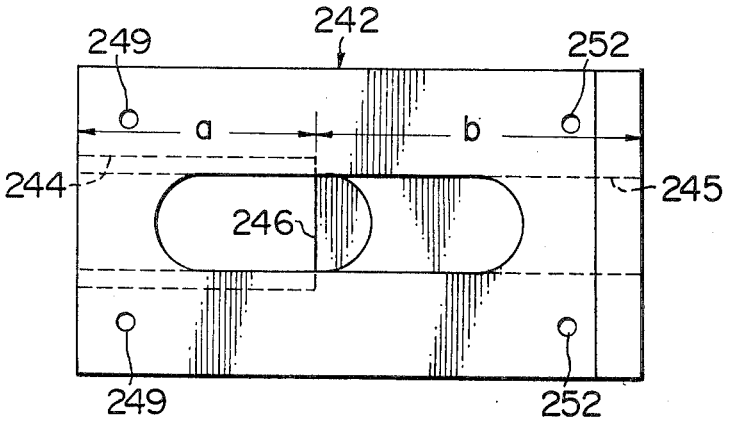
FIG. 33 is a bottom view of the cylinderblock.
Figure 34:
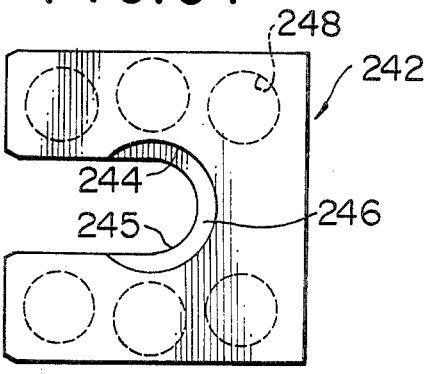
FIG. 34 is a left front view of the cylinder block.
Figure 35:
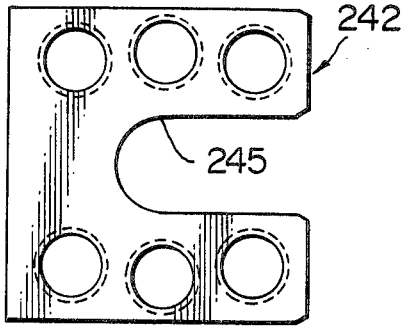
FIG. 35 is a right front view of the cylinder block.

Then, a cotter 231 is pressed between the grooves 229*a* and 229*b* of the legs 228*a* and 228*b* of the supporter 223 and the sheets 225*a* and 225*b* are closed, whereby said one end of the sleeve A is struck onto the annular supporting face 232 of the supporter 223, as shown in FIG. 25.

Then, the hydraulic pressure unit 241 is actuated again, and the remaining half of the sleeve A is swaged, to thereby complete coupling of steel bars B by the sleeve A.

According to the foregoing third embodiment of the present invention, the stroke length of the hydraulic pressure unit can be reduced to almost a half of the stroke length in the conventional apparatus (namely, to almost half of the length of the sleeve). Therefore, the length of the hydraulic pressure unit in the axial direction can be reduced to almost half of the axial length in the conventional apparatus and the distance between the die frame and intermediate frame when they are most separated from each other can also be reduced to almost half of said distance in the conventional apparatus (namely, to almost half of the sleeve length). Accordingly, the entire length of the coupling apparatus of the present invention can be shorted by a length corresponding substantially to the sleeve length as compared with the entire length of the conventional coupling apparatus, and hence, the size and weight of the coupling apparatus can be greatly reduced in the present invention.

What is claimed is:

1. An apparatus for coupling two deformed steel bars by one sleeve, said apparatus comprising:

split dies having a bearing portion of smaller inner diameter than the outer diameter of said sleeve, a substantially U-shaped die frame for supporting said dies, rods connected at one end thereof to said die frame, a substantially U-shaped bottom frame attached to the other ends of said rods, a substantially U-shaped intermediate frame supported on said rods between said die frame and said bottom frame so that the intermediate frame can freely slide along said rods and can receive at one side face thereof one end of the sleeve, a substantially U-shaped hydraulic pressure unit including a plurality of cylinders that can be interposed between said bottom frame and said intermediate frame to slide said intermediate frame along said rods, said dies comprising upper and lower dies split and separated from each other in a plane passing through the axial line of said dies, the split faces of said upper and lower split dies having convex and concave portions to be engaged with each other, said upper die having upper shoulder faces parallel to the axial line, said lower die having an inclined bottom face slanted at an angle to the axial line, said die frame having parallel faces confronting said upper shoulder faces to support them and a further inclined face confronting said inclined bottom face to support it, and means on said die frame for movably supporting said lower die whereby said lower die can be displaced from a support position on said further inclined face of said die frame to a removed position to one side of said die frame.

* * * * *